United States Patent [19]

Moser

[11] 4,395,929

[45] Aug. 2, 1983

[54] METHOD AND STAMPING TOOL FOR WASTE-FREE STAMPING OF PACKAGING STRIPS AND PACKAGING STRIPS SO FABRICATED

[75] Inventor: Theo Moser, Steinenberg, Fed. Rep. of Germany

[73] Assignee: Robert Bosch GmbH, Stuttgart, Fed. Rep. of Germany

[21] Appl. No.: 354,578

[22] Filed: Mar. 4, 1982

[30] Foreign Application Priority Data

Mar. 6, 1981 [DE] Fed. Rep. of Germany ..... 3108490

[51] Int. Cl.[3] ..... B31B 1/22; B65B 9/04

[52] U.S. Cl. ..... 83/686; 83/50; 83/694; 83/925 R

[58] Field of Search ..... 83/50, 55, 670, 685–689, 83/694, 925 R, 237; 53/549, 427

[56] References Cited

U.S. PATENT DOCUMENTS 4,317,399 3/1982 Romagnoli ..... 83/237

*Primary Examiner*—James M. Meister

*Attorney, Agent, or Firm*—Edwin E. Greigg

[57] ABSTRACT

The invention sets forth a method and a corresponding stamping tool for waste-free stamping out packaging strips such as the so-called press-through packages. These press-through packages are made of a strip of foil comprising a lower foil strip with depressions for receiving tablets, lozenges or the like and a foil cover strip which closes off the depressions. The individual packaging strips, in order to enable problem-free further processing and to avoid injuries, have rounded corners. In order to avoid sharp, hooklike protrusions, which in the waste-free stamping out of packaging strips are created whenever there is shifting in the advancement of the length of foil, the forward stamping edge of the stamping tool is embodied in accordance with the invention such that when a packaging strip is stamped out, this forward stamping edge intersects the rearward edge of the previously stamped packaging strip such that an obtuse angle is created at the front edge of the packaging strip, seen in the direction of advancement of the strip. By so embodying the forward stamping edge of the stamping tool, packaging strips are produced which have a substantially uniform outer appearance, even despite various shifts in advancement, all four rounded corners of one packaging strip have the same radius.

3 Claims, 9 Drawing Figures

METHOD AND STAMPING TOOL FOR WASTE-FREE STAMPING OF PACKAGING STRIPS AND PACKAGING STRIPS SO FABRICATED

BACKGROUND OF THE INVENTION

In fabricating packaging strips, preferably press-through packages which are made from a strip of foil comprising a lower foil strip with depressions for receiving tablets, lozenges or the like, and a foil cover strip which closes the depressions and is combined with the lower foil strip by heat-sealing, it is very important that the desired individual package units be stamped out with very little trimming waste, or in any event with as little waste as possible. A so-called "waste-free stamping operation" is performed by making the trailing edge of one packaging strip the leading edge of the next packaging strip when the foil strips are separated. Thus nothing is wasted between the individual packaging strips. A further requirement for such packaging strips is that the corners of the packaging strips must be rounded. This is very important in the further processing of these packaging strips, because otherwise it becomes difficult to insert such packaging strips into cardboard boxes or the like. Furthermore, packages lacking rounded corners would present the danger of injury both to the worker processing them and, especially, to the final consumer for whom the package is intended.

For various reasons, for example a change in the foil as it passes through the processing machinery or shrinkage of the foil, particularly while the machinery is stopped, there is always a slight nonuniformity in the advancement of the foil strips, so that it is impossible to effect the stamping cut with the desired degree of exactness. In consequence, the stamping cut for the front edge of one package strip may not be located precisely at the stamping cut made earlier for the immediately previous packaging strip. As a result, sharp, hooklike protrusions are created in the vicinity of the round corners at the front of a packaging strip, viewed in the direction in which the strip is advanced; as would also be the case with packaging strips not having rounded corners, this phenomenon can cause interruptions in the further processing steps and are a possible cause of injury.

In order to prevent sharp protrusions of this kind, it has already been proposed in (Japanese Patent Application No. 55/45360) that packaging strips be fabricated by a method such that the forward corners in the direction of advancement have a different arcuate radius from the rear corners. As is particularly shown in FIG. 4 of this Japanese patent application, the intention is thereby, at the overlap of the arcs of different radii, to prevent the sharp protrusion that would otherwise be created where arcs of equal radii intersect. However, it has been found that with this kind of procedure it is not possible to eliminate sharp protrusions completely; with this method, the sharp protrusions produced by earlier known methods can only be diminished somewhat. Furthermore, packaging strips having rounded corners of unequal radii are not favored in the pharmaceutical industry, because there is the disadvantage not only of the non-uniform outer appearance, but also of difficulties in further processing, especially when placing the packages in cartons.

It is desirable to have a method and a stamping tool for fabricating packaging strips with rounded corners of equal radii by which the packaging strips can be stamped out in a waste-free manner without impairment of further processing and where the packaging strips do not present a possible cause of injury.

OBJECT AND SUMMARY OF THE INVENTION

The method according to the invention has the overall advantage that while packaging strips are stamped out in a completely waste-free manner, there are no sharp, hooklike protrusions formed on any of the edges of the packaging strips. The matrix of the stamping tool has rounded corners of equal radii. Moreover, the system is arranged such that the rounded corners located at the front in terms of the direction of movement of the packaging strips each comprise two arcs of equal radius, the arcs being interconnected by a tangent. Thus, despite fluctuations in the speed of packaging strip advancement, problematical protrusions are no longer created, and the packages have a uniform appearance. Furthermore, these packaging strips can be packaged in cartons without difficulty. There is no longer any danger of injury, because of the manner in which the corners are embodied according to the invention.

By applying the characteristics disclosed herein, advantageous further embodiments of and improvements to the stamping apparatus according to the invention and the package according to the invention are attainable.

The invention will be better understood and further objects and advantages thereof will become more apparent from the ensuing detailed description of a preferred embodiment taken in conjunction with the drawings.

BRIEF DESCRIPTION OF THE DRAWINGS

The drawings show one exemplary embodiment of a stamping tool for performing the method according to the invention, as well as packaging strips so fabricated. The drawings also show packaging strips fabricated in accordance with the previously known method.

DESCRIPTION OF THE PREFERRED EMBODIMENT

Figure 1:
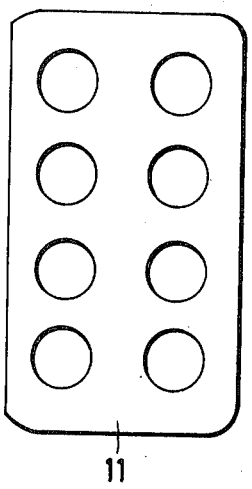
FIGS. 1, 2 and 3 show packaging strips which depict the prior art all of which have more or less sharp protrusions such as could occur if the foil strips were nonuniformly advanced or displaced to the side.
Figure 2:
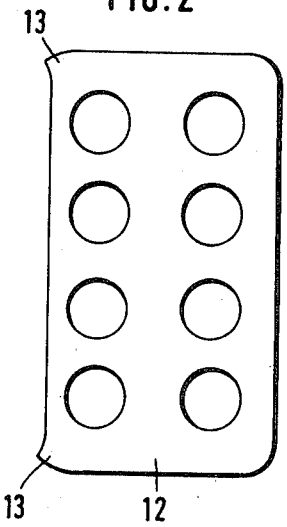
PRIOR ART FIG.2

FIGS. 1 and 2 show packaging strips 11 and 12, which result with the conventional method if there is shifting in the direction of advancement of the foil strips to be stamped out. In the most favorable case, that is, if the amount of misplacement is very small, the result is a packaging strip 11 as shown in FIG. 1. Most often, however, the conventional method produces a packaging strip 12 with hooklike protrusions 13 such as are shown in FIG. 2. A packaging strip as shown in FIG. 3 is created if there is not only shifting in the advancement of the corresponding foil strips, but a lateral shift as well.

Figure 3:
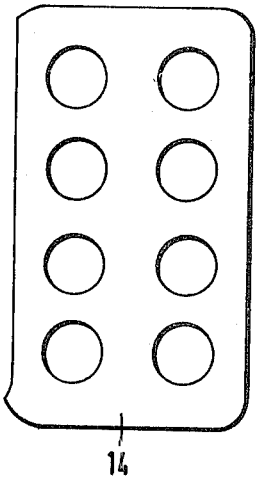
PRIOR ART FIG.3
Figure 4:
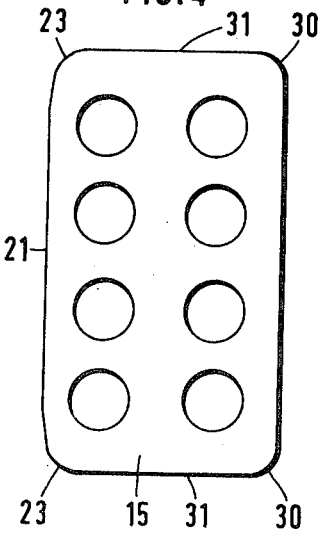
PRIOR ART FIG.4
FIGS. 4, 5 and 6 show packaging strips which have been fabricated by the method according to this invention while using the stamping tool according to this invention.
Figure 5:
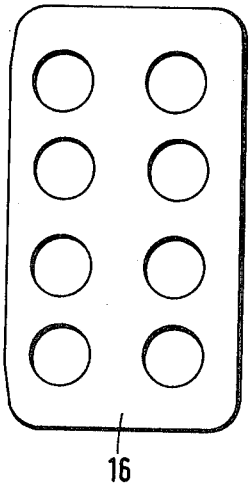
Figure 6:
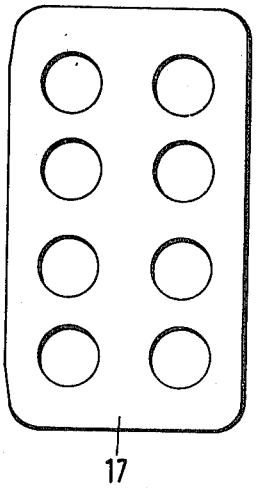

FIGS. 4, 5 and 6 show packaging strips 15, 16 and 17, which have been produced under the same conditions as packaging strips 11, 12 and 14 shown in FIGS. 1, 2 and 3, but instead using this method according to the invention. It is clearly visible that in this case, no problematical protrusions, which are more or less sharp-pointed, are created at all. As may be seen in the case of the packaging strip 17 shown in FIG. 6, this is true even if there is a dual misplacement of the foil strips, that is, in both the forward and lateral directions. In addition to the satisfactory appearance of the packaging strips 15, 16 and 17 shown in FIGS. 4, 5 and 6, these packaging strips can be processed further without interruptions, and they represent no danger whatever of injury either to the worker performing the further processing or to the final consumer.

Figure 7:
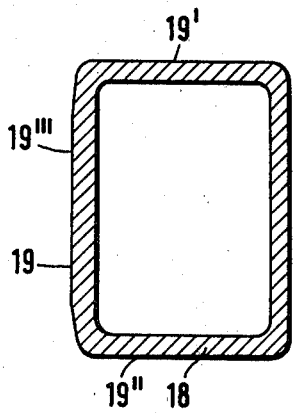
FIG. 7 is a cross-sectional view taken through the stamping tool.
Figure 8:
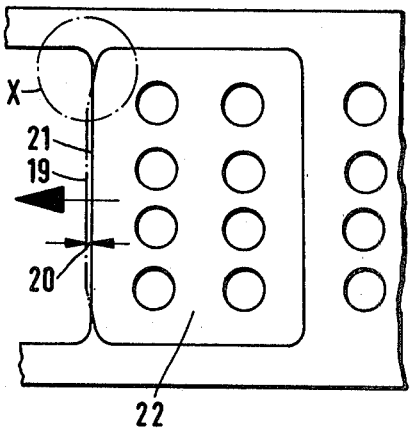
FIG. 8 shows the foil strips from which the packaging strips are stamped out, in particular a packaging strip which has been stamped out just previously.
Figure 9:
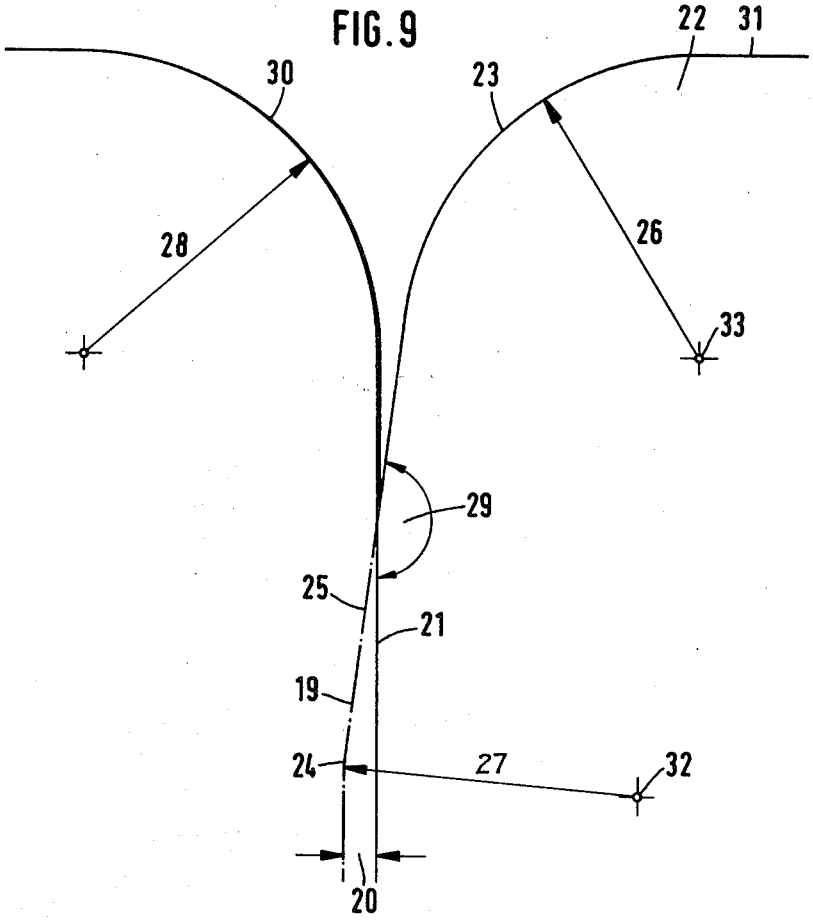
FIG. 9, on a much larger scale, shows schematically the detail of a portion of FIG. 8 marked by the letter X.

The stamping tool 18, shown in FIG. 7, is used to produce the packaging strips 15, 16 and 17. The course of the stamping line on longitudinal edge 19 of the stamping tool 18 is selected such that even if there is foil strip misplacement 20 such as is shown in FIGS. 8 and 9, the stamping line 19 of the stamping tool 18 intersects the edge 21 of the previous packaging strip such that sharp edges are not produced on the longitudinal edge of the subsequent packaging strip 22; this is particularly clearly shown in FIG. 9. As FIG. 9 also shows, the upper end of the stamping line 19 of the stamping tool 18 denoted by an X in FIG. 8 is formed by two arcuate lines 23 and 24 separated by a straight line 25 which is tangent to each of the arcuate lines 23 and 24. The radius 26 of the arcuate line 23 which forms the upper rounded corner equals the radius 27 of the arcuate line 24 along the longitudinal edge 19. The arrangement is further selected such that the size of the radii 26 and 27 of arcuate lines 23 and 24, respectively, are adapted to the size of the radius 28 of the arcuate line 30—that is, the radius of the rounded corners of the rear edge of the packaging strips. The result, accordingly, is rounded corners of equal radii for the forward and rear edges of every packaging strip. The lower end of the longitudinal edge 19 is formed with arcuate lines separated by a straight line such as described for the upper end. The portion of the longitudinal edge 19''' between the arcuate edges 24 is a straight line. The rear corners are formed with the same arcuate lines radius as that of arcuate line 23 with a straight line forming the two arcuate lines of the upper and lower corners. The edges 19' and 19'' are also formed by straight lines between the arcuate rounded corners of the front and rear edges of the upper and lower corners.

FIG. 9 also clearly shows that with this method and with this embodiment of the stamping edge 19 of the stamping tool 18, there can be a relatively great shift in either the forward or the lateral direction without resulting in the creation of the known problematical, sharp-pointed, hook-like protrusions. This advantage is brought about by the tangent 25 interconnecting the two arcuate lines 23 and 24. This tangent 25 intersects the edge 21 of the previously stamped packaging strip, which forms the longitudinal edge of the next subsequent packaging strip, in the area in which it is straight, resulting in an obtuse angle 29 between the two edges. The misplacement in the forward direction must naturally not be so great that the circular line 23 intersects the circular line 30, because in that case the result would be a packaging strip 12 as shown in FIG. 2.

As may further be seen from FIG. 9, the center 32 of the circular line 24 is disposed offset from the center 33 of the circular line 23, viewed in the direction of advancement of the packaging strips 22.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A stamping tool for producing a substantially rectangular packaging strip comprising a lower foil containing depressions for receiving tablets, lozengers or the like and a cover foil covering the depressions, said packaging strip to have all corners of equal radii, the forward stamping edge of the stamping tool which forms the upper and lower corners of the packaging strip located at the front in the direction of advancement through the stamping tool has, in order to create one corner, first and second arcuate lines each having the same radii of curvature which equals the radius of curvature for forming the arcuate line of the rear corners of the packaging strip, and a straight line tangent to said first and second spaced arcuate lines forming the forward stamping corner edges.

2. A stamping tool as defined by claim 1, in which the stamping edges creating the edges of the packaging strip located on the narrow sides, are tangent to said first arcuate line of the stamping edge of the stamping tool for creating the two corners of the packaging strip located at the front, and the stamping edge formed between said second arcuate lines creates the long edge of the packaging strip located at the front in the direction of advancement.

3. A stamping tool as defined by claims 1 or 2, characterized in that the center of curvature of the second arcuate line is disposed offset from the center of curvature of said first arcuate line, viewed in the direction of advancement of the packaging strips.

* * * * *